US008662269B2

(12) United States Patent
Shor et al.

(10) Patent No.: US 8,662,269 B2
(45) Date of Patent: Mar. 4, 2014

(54) CARRYING CASE FOR PORTABLE ELECTRONIC DEVICES WITH SUSPENDED INNER COMPARTMENT

(75) Inventors: Otniel Shor, Colts Neck, NJ (US); Todd Kramer, Marlton, NJ (US)

(73) Assignee: Avenues in Leather, Inc., Tinton Falls, NJ (US)

( * ) Notice: Subject to any disclaimer, the term of this patent is extended or adjusted under 35 U.S.C. 154(b) by 383 days.

(21) Appl. No.: 12/928,382

(22) Filed: Dec. 10, 2010

(65) Prior Publication Data

US 2012/0145499 A1 Jun. 14, 2012

(51) Int. Cl.
*A45C 3/00* (2006.01)

(52) U.S. Cl.
USPC ..... 190/109; 190/102; 190/103; 190/107; 190/111; 190/110; 190/112; 190/114; 190/117; 206/112; 206/223; 206/320; 206/316.1; 224/576; 224/581; 224/605; 224/657; 383/3; D14/335; D14/267; D14/289; D14/301

(58) Field of Classification Search
USPC ..... 190/100, 109, 110, 117, 114, 112, 18 R; 206/316.1, 317, 320, 522, 570, 578, 206/579, 586; D3/279, 283, 284, 285, 289, D3/301
See application file for complete search history.

(56) References Cited

U.S. PATENT DOCUMENTS

| | | | | | |
|---|---|---|---|---|---|
| 1,653,246 | A | * | 12/1927 | Zichy | 206/223 |
| 2,691,401 | A | * | 10/1954 | Kontoff et al. | 206/316.1 |
| 3,904,003 | A | * | 9/1975 | Margerum | 190/11 |
| 5,217,119 | A | | 6/1993 | Hollingsworth | |
| 5,263,587 | A | | 11/1993 | Elkin et al. | |
| 5,360,108 | A | | 11/1994 | Alagia | |
| 5,524,754 | A | * | 6/1996 | Hollingsworth | 206/320 |
| 5,884,768 | A | | 3/1999 | Fox | |
| 6,105,764 | A | | 8/2000 | Scicluna et al. | |
| 6,109,434 | A | | 8/2000 | Howard | |
| 6,131,734 | A | * | 10/2000 | Hollingsworth et al. | 206/320 |
| 6,516,927 | B2 | * | 2/2003 | Krulik | 190/114 |
| 6,547,070 | B1 | * | 4/2003 | Kolpin | 206/317 |
| D512,219 | S | | 12/2005 | Yeo | |
| 7,631,756 | B2 | * | 12/2009 | Picot et al. | 206/320 |
| 2002/0027052 | A1 | * | 3/2002 | Godshaw et al. | 190/111 |
| 2005/0284791 | A1 | * | 12/2005 | Sadow | 206/522 |
| 2006/0090823 | A1 | * | 5/2006 | Repke et al. | 150/113 |

* cited by examiner

*Primary Examiner* — Anthony Stashick
*Assistant Examiner* — Cynthia Collado
(74) *Attorney, Agent, or Firm* — Lawrence G. Fridman

(57) ABSTRACT

A carrying case for a portable electronic device includes an inner compartment having a front panel and a side panel extending peripherally around the front panel to define a hollow interior. A pivotal flap extending across width of the front panel is formed as an upper part of the front panel connected thereto through a living hinge. A plurality of spaced resilient dimples extends into the interior of the inner compartment from at least the front panel. The living hinge comprises an internal crease in a front panel material. The internal crease extends inwardly in to the material toward an exterior of the inner compartment from the front panel.

16 Claims, 14 Drawing Sheets

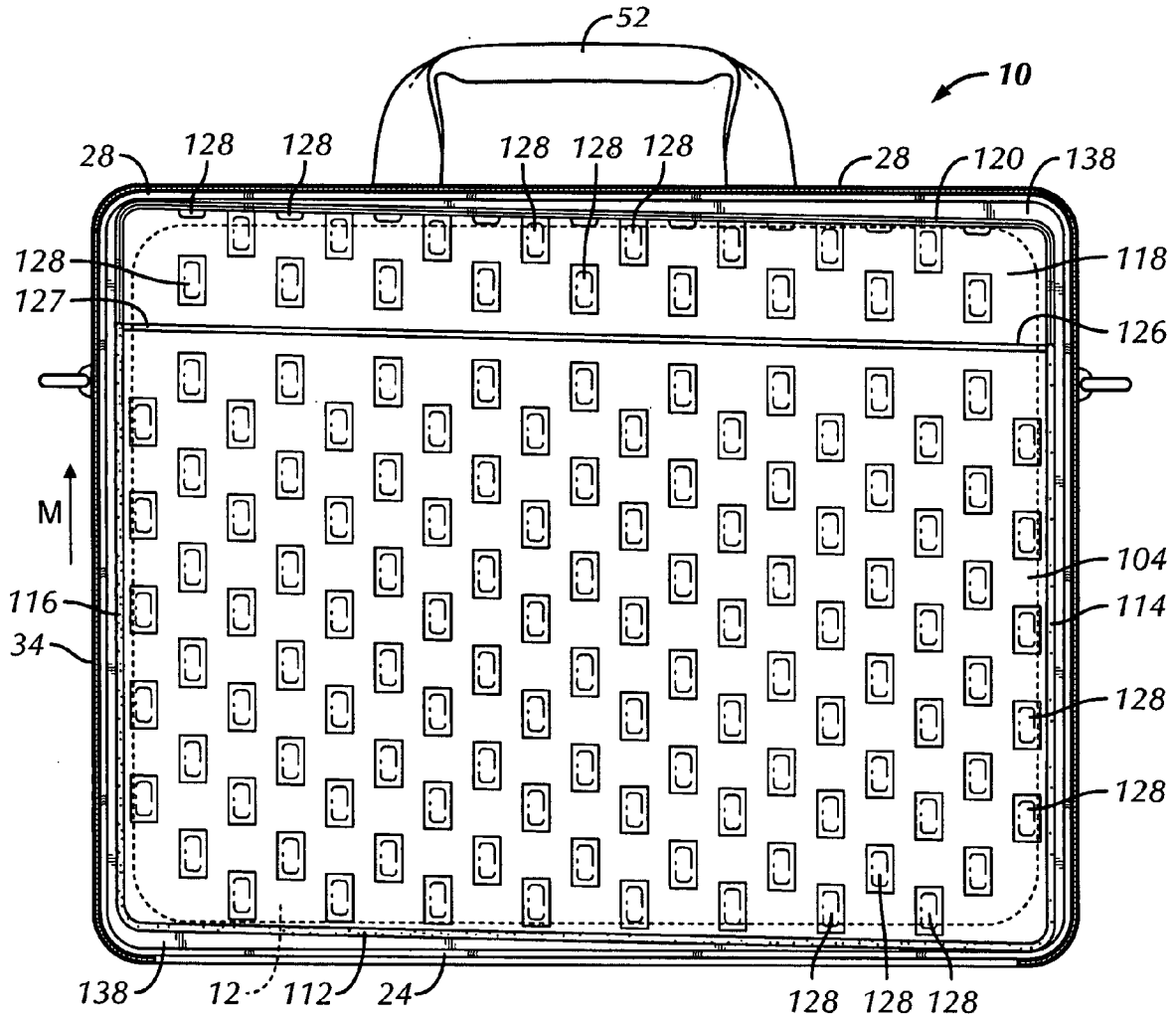
10
138
120
28
52
118
126
104
114
128
128
128

CARRYING CASE FOR PORTABLE ELECTRONIC DEVICES WITH SUSPENDED INNER COMPARTMENT

BACKGROUND OF THE INVENTION

This invention generally relates to carrying cases, and more particularly to protective carrying cases for portable electronic devices, such as laptop computers.

Portable electronic devices, such as laptop computers, mobile phones, mP3 players, electronic readers, and so on, have increased in popularity rather dramatically over the years. Although efforts are made by the manufacturers of such devices to reduce cost and improve robustness, they are subject to damage due to the relatively fragile nature of their internal components and displays. The inadvertent dropping or bumping of such devices can cause damage beyond repair. Laptop computers typically require a much higher investment of time and money than other portable electronic devices. In addition, the loss of valuable data created over many hours, days, months and years can be detrimental when the computer is damaged. Accordingly, efforts have been made to protect laptop computers during transportation and storage in the form of carrying cases with various solutions for reducing impact forces on the computer when dropped or bumped.

BRIEF SUMMARY OF THE INVENTION

According to one aspect of the invention, a carrying case for a portable electronic device includes an outer case having a front wall, a rear wall, and a side wall extending between and peripherally around the front and rear walls, and an inner compartment located within the outer case. The inner compartment is suspended in a cantilever-type fashion from one of the walls of the outer case and includes a front panel and a side panel extending peripherally around the front panel to define a hollow interior into which the portable electronic device can be received. The side panel is spaced from the side wall to define a deceleration zone into which a portion of the inner compartment can travel when the carrying case is subjected to a deceleration force to thereby protect the portable electronic device from full impact of the deceleration force.

According to a further aspect of the invention, a carrying case for a portable electronic device includes an outer case having a front wall, a rear wall, and a side wall extending between and peripherally around the front and rear walls, and an inner compartment located within the outer case. The inner compartment includes a front panel and a side panel extending peripherally around the front panel to define a hollow interior into which the portable electronic device can be received. A pivotal flap extends across a width of the front panel to thereby close the hollow interior of the inner compartment. The pivotal flap is formed as an upper part of the front panel through a living hinge that extends across the width of the front panel.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein:

FIG. 7C is a sectional view similar to FIG. 7 showing movement of the interior compartment when subjected to a force along the first direction.

Figure 1:
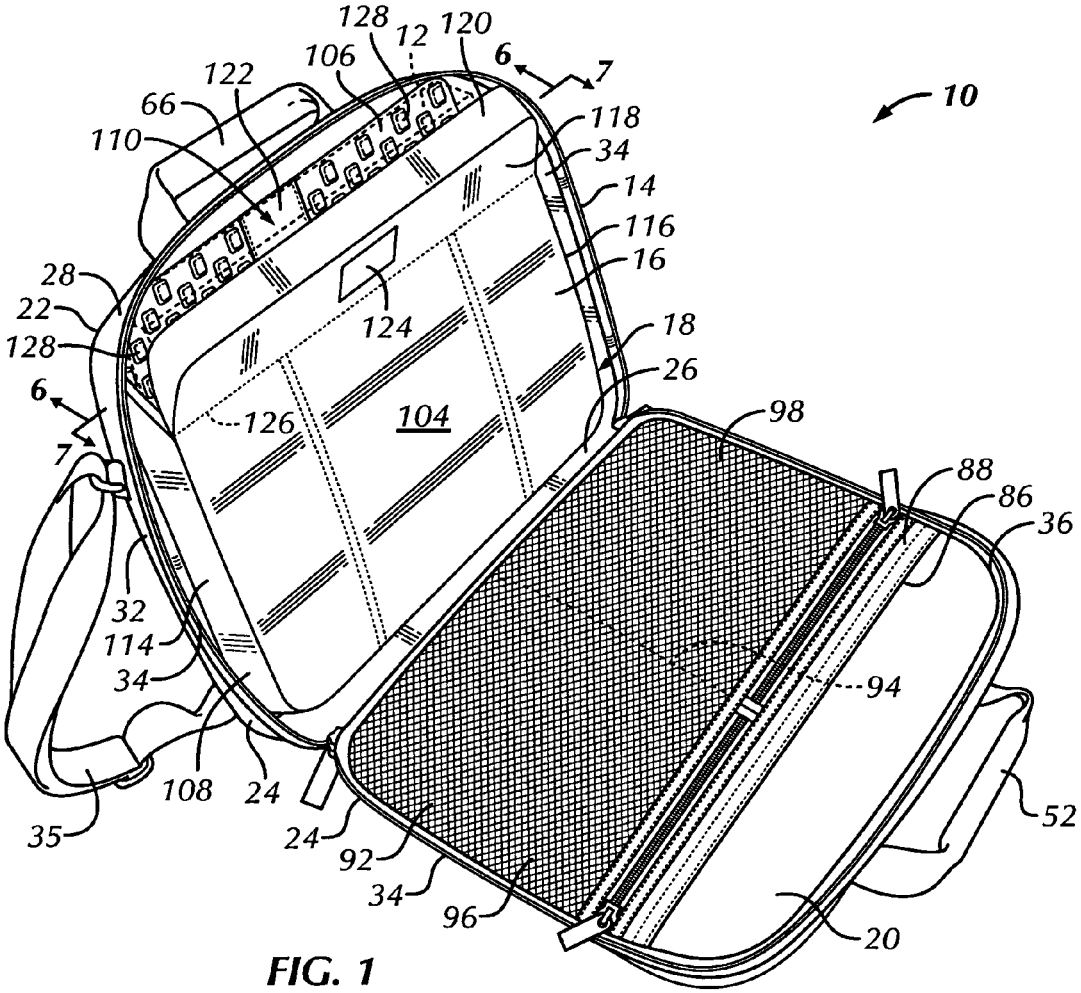
FIG. 1 is a perspective view of a carrying case in a partially open position exposing a partially opened interior compartment for accessing a portable electronic device, such as a laptop computer represented by broken line.

It is noted that the drawings are intended to depict only typical embodiments of the invention and therefore should not be considered as limiting the scope thereof. It is further noted that the drawings are not necessarily to scale. The invention will now be described in greater detail with reference to the accompanying drawings.

DETAILED DESCRIPTION OF THE INVENTION

Referring to the drawings, and to FIGS. 1-5 in particular, a carrying case 10 for transporting and protecting a portable electronic device, such as a laptop computer 12 (shown in broken line) is illustrated. The carrying case 10 preferably includes an outer case 14 and a reinforced inner compartment 16 located within the interior space 18 of the outer case. The reinforced inner compartment 16 is preferably connected to the outer case 14 and suspended therefrom through a unique seam construction, as will be described in greater detail below.

Figure 4:
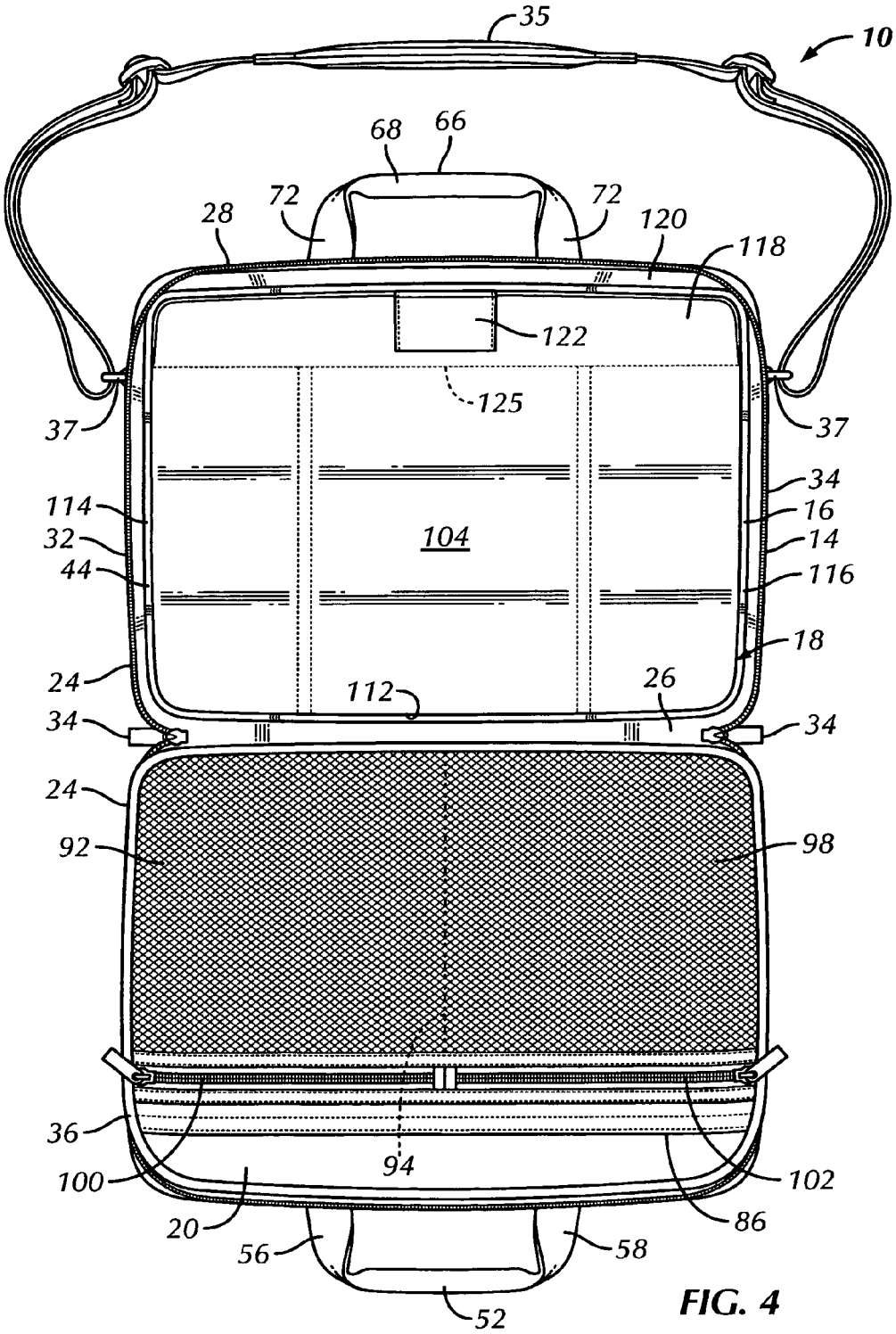
FIG. 4 is a top plan view of the carrying case in a fully open position.

The outer case 14 preferably includes a front wall 20, a rear wall 22 and a continuous side wall 24 extending between the front and rear walls to form the interior space 18. The continuous side wall 24 preferably includes a bottom side wall section 26, a top side wall section 28, and left and right side wall sections 30 and 32, respectively that extend between the bottom and top side wall sections. Preferably, the top, right and left side wall sections are bifurcated and bordered with a zipper 34 for selectively closing and opening the interior space 18. It will be understood that other closure means, such as hook and loop fasteners, straps, buttons, snaps, and so on, can be used without departing from the spirit and scope of the present invention. This clamshell-like construction permits the carrying case 10 to open to a completely flat position, as shown in FIG. 4, to provide easy access to the contents located with the interior space 18. A carrying strap 35 can be connected to opposite sides of the outer case 14 through attached D-rings 37 or other well-known arrangement.

The front wall 20, rear wall 22 and continuous side wall 24 are preferably constructed of a core layer comprising a resilient and flexible open cell foam material sandwiched between outer fabric layers to protect the contents of the carrying case 10 and provide an aesthetically pleasing appearance to both users and observers.

A continuous front seam 36 (FIGS. 2 and 5) preferably extends around the periphery of the front wall 20 and connects a forward edge 38 (FIG. 5) of the continuous side wall 24 with a rearward edge 40 of the front wall 20 through stitching 42 (shown in dashed line) or other connecting means such as adhesive bonding, clamping, and so on. A finishing strip 43 preferably wraps around the forward edge 38 and rearward edge 40 to strengthen the front seam 36 and provide a more aesthetically pleasing finish. Likewise, a continuous rear seam 44 (FIGS. 3 and 5) preferably extends around the periphery of the rear wall 22 and connects a rearward edge 46 (FIG. 5) of the continuous side wall 24 with a forward edge 48 of the rear wall 22 through stitching 50 (shown in dashed line) or other connecting means. Further details of the rear seam 44 will be described below in conjunction with the inner compartment 16.

Figure 2:
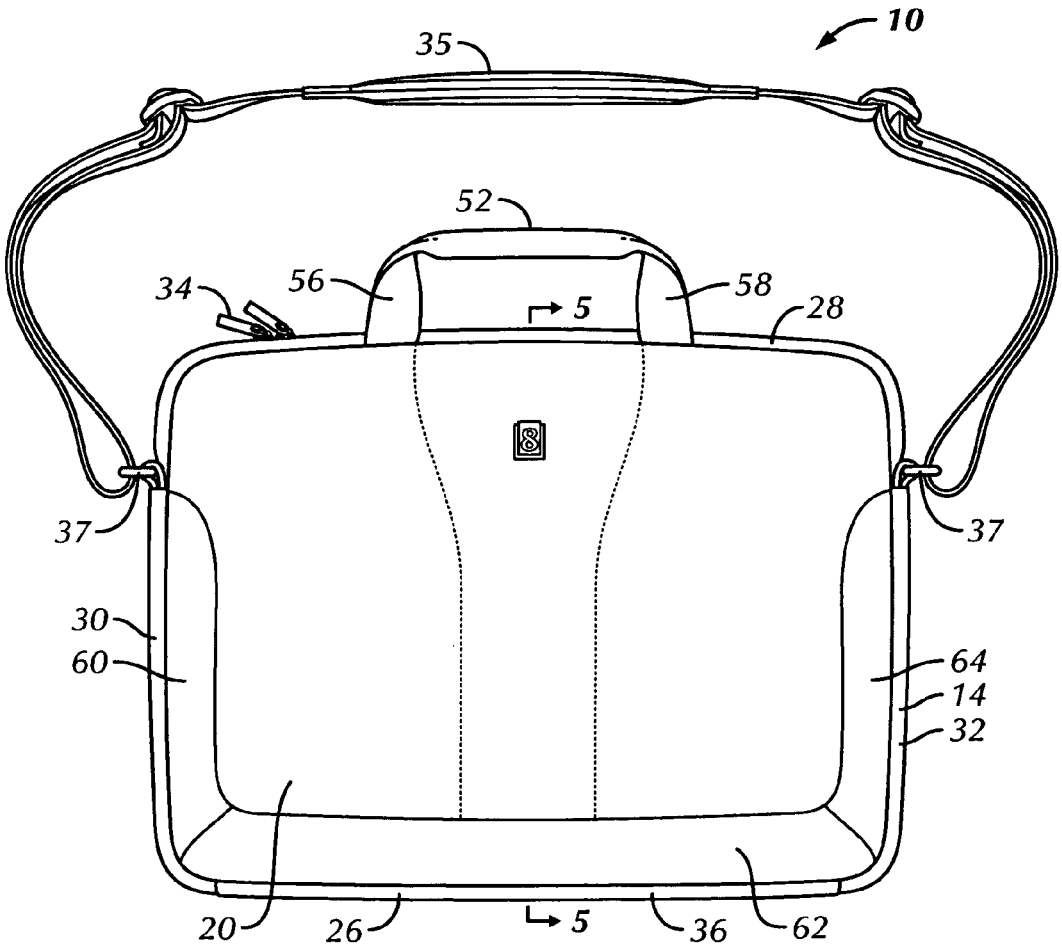
FIG. 2 is a front elevational view of the carrying case.

As best shown in FIG. 2, a front handle 52 is preferably generally U-shaped in configuration and includes a gripping portion 54 and a pair of leg portions 56, 58 extending from either side of the gripping portion. An outer free end of each leg portion 56, 58 is preferably sewn into the continuous front seam 36 between the front wall 20 and the top side wall section 28 of the continuous side wall 24. Front reinforcing segments 60, 62 and 64 are preferably formed as part of the front wall 20 adjacent the left side wall section 30, bottom side wall section 26, and right side wall section 32, respectively. The segments 60, 62 and 64 are also preferably sewn into the continuous front seam 36.

Figure 3:
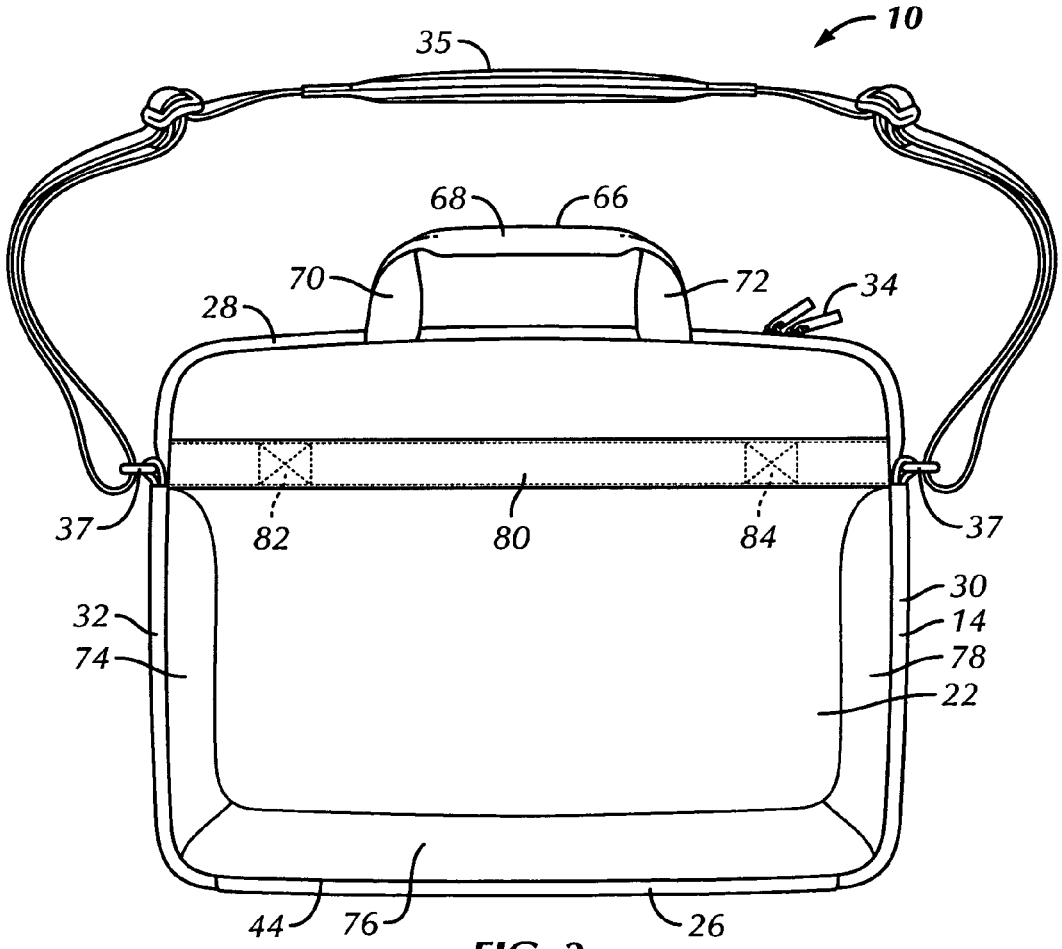
FIG. 3 is a rear elevational view thereof.

As best shown in FIG. 3, a rear handle 66 is preferably identical in construction to the front handle 52 and therefore is generally U-shaped in configuration with a gripping portion 68 and a pair of leg portions 70, 72 extending from either side of the gripping portion. An outer free end of each leg portion 70, 72 is preferably sewn into the continuous rear seam 44 between the rear wall 22 and the top side wall section 28 of the continuous side wall 24. Rear reinforcing segments 74, 76 and 78 are preferably formed as part of the rear wall 22 adjacent the right side wall section 32, bottom side wall section 26, and left side wall section 30, respectively. The front reinforcing segments 60, 62 and 64, the rear reinforcing segments 74, 76 and 78, and a substantial portion of the side wall sections 26, 30 and 32 are preferably constructed of the same reinforcing material while the remaining areas of the outer case 14 are constructed of a material that is softer to the touch. A reinforcing band 80 is preferably attached to the rear wall 22 at stitch areas 82 and 84, and is also preferably sewn into the continuous rear seam 44. With this construction, the reinforcing band 80 can be grasped between the areas 82, 84 for opening or closing the outer case 14 in addition to one or more of the handles 52, 66, while providing extra support for the computer during transport and storage. In this manner, a softer material that is agreeable to the touch can be used for a substantial portion of the rear wall 22 without compromising the integrity of the outer case 14.

Although not shown, pockets, pouches, or other outside compartments can be associated with either or both of the front and rear walls without departing from the spirit and scope of the present invention.

Figure 5:
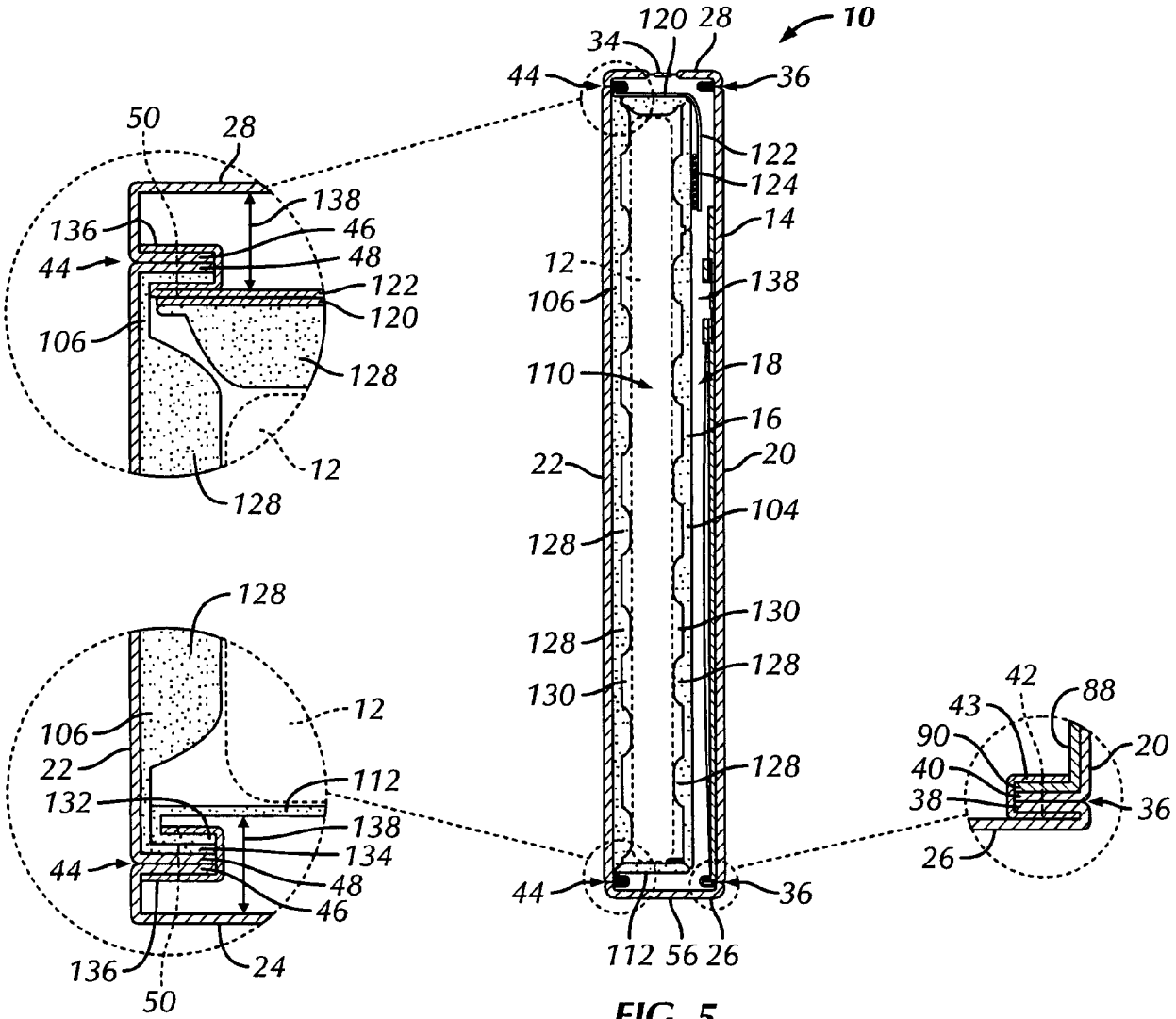
FIG. 5 is a sectional view of the carrying case taken along line 5-5 of FIG. 2.

Referring now to FIGS. 1, 4 and 5, the outer case 14 also preferably includes an inner pouch 86 that extends across the interior of the front wall 20. Preferably, the pouch 86 is constructed from a single sheet 88 of material, the outer peripheral end or rear edge 90 (FIG. 5) of which is sewn into the continuous front seam 36 adjacent the left side wall section 30, bottom side wall section 26, and right side wall section 32, and is preferably covered by the finishing strip 43. A layer of mesh material 92 preferably extends across the inner pouch 86 and is also sewn into the continuous front seam 36 and across a middle of the pouch, as represented by dashed line 94, to form two separate pockets 96 and 98. A zipper 100 and 102 or other closure means as previously described, is preferably associated with each pocket 96 and 98.

Figure 9:
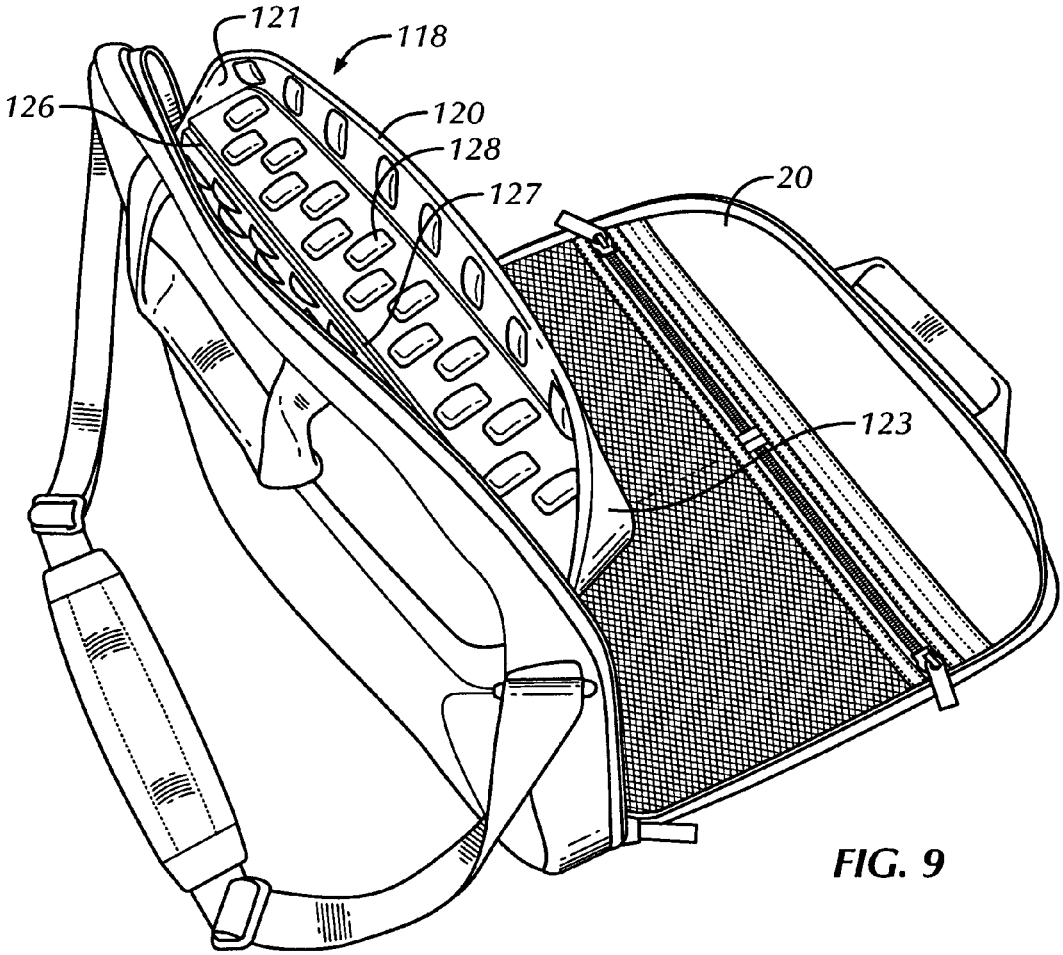
FIG. 9 is a further view of the carrying case showing a partially open interior compartment with a pivotal flap and living hinge.

Referring now to FIGS. 1, 3 and 5-7, the reinforced inner compartment 16 preferably includes a front panel 104, a rear panel 106, a side panel 108 extending peripherally along and between the front and rear panels to form a hollow interior 110 into which the computer 12 (shown in dashed line in FIG. 1) or other electronic device can be received. The side panel 108 preferably includes a bottom side panel section 112 and left and right side panel sections 114 and 116, respectively, that extend from the bottom side panel section towards a pivotal flap 118. The pivotal flap 118 connected to the front panel 104 through a living hinge 126 (see at least FIGS. 7 and 9) and extends across the entire width of the front panel. The living hinge 126 has an external region 125 and an internal region 127. The external region 125 is preferably formed by stitching across the front panel 104, thereby creating an external crease in the fold of the material. The internal region 127 and the respective crease will be discussed in greater detail hereinbelow. The creases allow the flap to be pivoted when the computer is moved in and out of the inner compartment 16. The flap 118 includes a top pivotal section 120 extending along the front panel 104 and side sections 121 and 123 extending from each end of the section 120. In this manner, corner-shaped formations are formed by the panel sections at each end of the flap. The side panel sections 121 and 123 of the flap 118 mate with the side panel sections 114, 116 when in the inner compartment 16 is in the closed position to secure the contents of the hollow interior 110. A securing strap 122 preferably extends from the rear wall 22 and over the flap 118 when in the closed position. An outer free end of the securing strap 122 and an area of the flap 118 are provided with a hook and loop fastener 124 or other closure means such as previously described for holding the flap 118 in the closed position during transportation and storage. The opposite end of the securing strap 122 is preferably sewn into the continuous rear seam 44. The width and configuration of the pivotal flap 118 allows it to be pivoted against the front panel 104 when completely open with the top panel section 120 resting against the front panel portion of the flap 118 to expose an upper portion of the computer 12 or other electronic device, thereby facilitating its removal from the inner compartment 16 as well as its return thereto.

The inner surfaces of the front and rear panels 104, 106 as well as the front panel section below the living hinge 126 and at least the panel sections of the pivotal flap 118, are provided with a plurality of resilient dimples or cells 128 that extend into the interior 110 of the inner compartment 16 from a flexible base 129 of the respective panels. The dimples or cells are preferably semi-solid formations made from high-density foam and nylon that are heat-sealed together. The resilient, semi-solid dimples 128 are dispersed uniformly through the entire inner surfaces of the front and rear panels 104, 106 and pivotal flap 118. Each dimple 128 is preferably rectangular in shape with ramped surfaces to facilitate insertion and removal of the computer 12 or other portable electronic device. The dimples 128 allow the computer to be spaced several millimeters, such as 4 to 6 millimeters, away from the inner surfaces of the inner compartment 16 to provide a first deceleration gap or zone 130 (FIG. 5) for the computer 12 should the carrying case 10 be dropped. The front panel in the areas not covered by the dimples comprises a core layer which includes foam material sandwiched between outer fabric layers. As best illustrated in at least FIG. 7, in the hollow interior 110 including the front panel 104, the dimples are arranged linearly through the entire inner surface thereof. At the area of formation of the living hinge 126 adjacent rows of the dimples 128 are spaced from each other creating a free of dimples plain region. This facilitates formation of the respective creases. As shown in at least FIGS. 5 and 9, in the internal region 127 of the living hinge, the foam material of the core layer is removed enabling crease to extend inwardly into the fabric layers of the front panel. A stitching extending across the front panel 104 can be provided at the external region 125. The stitches of the external region 125 and the internal region 127 often coincide. In this manner, at the living hinge 126, the thickness of the material of the front panel 104 is minimal facilitating pivoting of the flap 118 during operation of the invention. It will be understood that the dimples can be constructed from other suitable compressible materials.

As best shown in FIG. 5, the continuous rear seam 44 also preferably connects a rearward edge 132 of the side panel 108 and a forward edge 134 of the rear panel 106 with the forward edge 48 of the rear wall 22 and the rearward edge 46 of the continuous side wall 24 through the stitching 50 (shown in dashed line) or other connecting means. A finishing strip 136 preferably wraps around the rearward edge 132, forward edges 134 and 48, and the rearward edge 46 to strengthen the rear seam 36 and provide a more aesthetically pleasing finish. This seam construction not only facilitates assembly of the carrying case 10 but also provides a reinforced second deceleration gap or zone 138 that surrounds a substantial portion of the inner compartment 16 and causes the inner compartment to be suspended from the rear wall 22 of the outer case 14 in a cantilever-type fashion such that the inner side panel 108, flap 118 and front panel 104 of the inner compartment 16 are separated from the continuous side wall 24 and front wall 20, respectively, of the outer case 14 by one or more predetermined distances that define the second deceleration gap or zone 138.

Figure 5C:
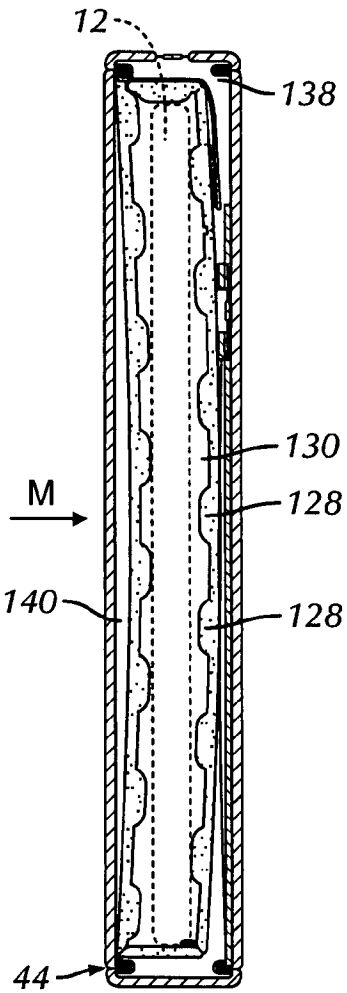
FIG. 5C is a sectional view similar to FIG. 5 showing movement of the interior compartment when subjected to a force along a third direction perpendicular to the first and second directions.
Figure 5B:
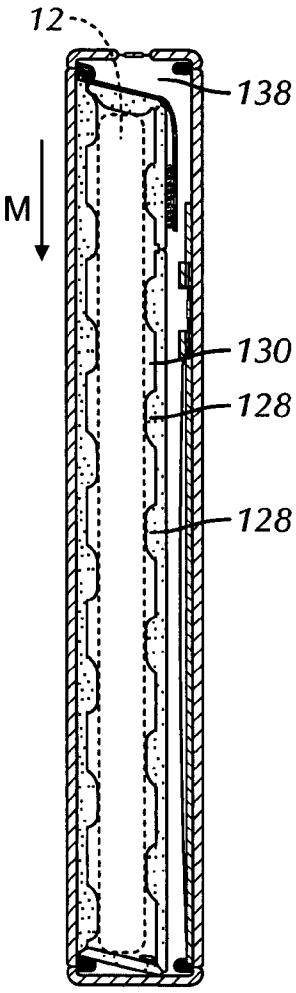
FIG. 5B is a sectional view similar to FIG. 5 showing movement of the interior compartment when subjected to a force along a second opposite direction.
Figure 5A:
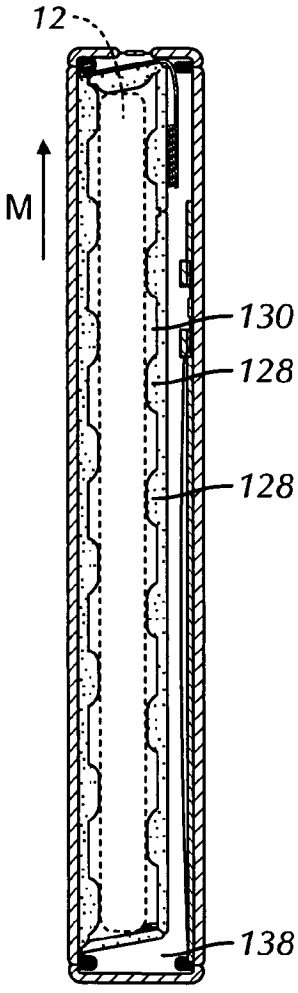
FIG. 5A is a sectional view similar to FIG. 5 showing movement of the interior compartment when subjected to a force along a first direction.
Figure 6:
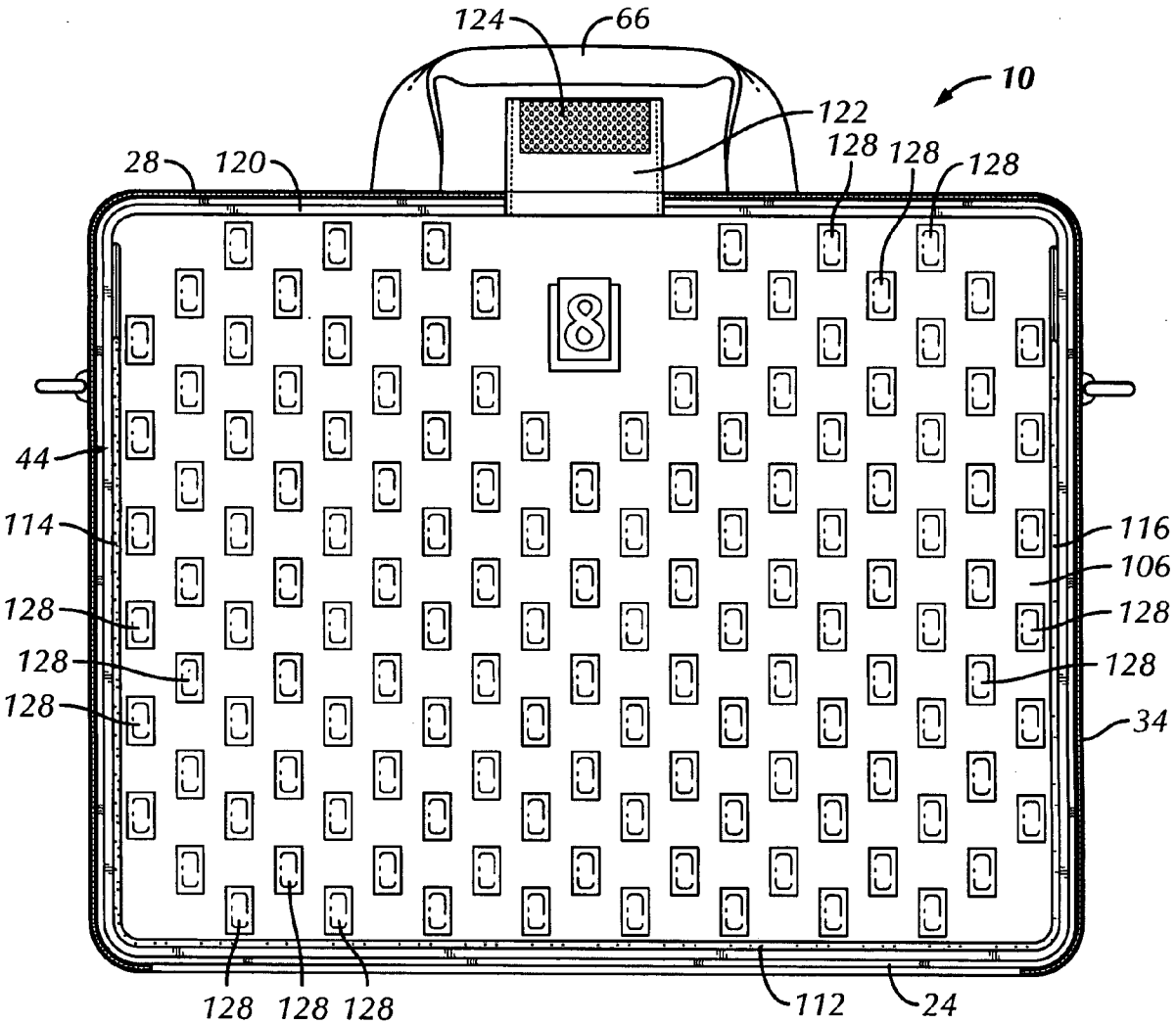
FIG. 6 is a sectional view of the carrying case taken along line 6-6 of FIG. 1.

Turning now to FIGS. 5A-5C, when the carrying case 10 is subjected to sudden deceleration forces in almost any orientation along three mutually perpendicular axes or combinations thereof, such as can occur when the carrying case is bumped or dropped, the above-described construction permits the computer 12 or other device to move into the first deceleration zone 130 between the resilient dimples 128, and the inner compartment 16 to move into the second deceleration zone 138, thus reducing the possibility of damaging forces being transmitted to the device. By way of example, when the carrying case 10 travels along a first direction of a first axis, as denoted by arrow M in FIGS. 5A and 7C, and meets an opposing stopping force caused by a fixed surface, such as a floor, wall, piece of furniture or other object (not shown), the cantilevered-type suspension of the inner compartment 14 permits movement of a portion of the inner compartment into the second deceleration zone 138 such that a greater gap is located at the bottom of the interior space 18 (FIG. 5) than at the top thereof. Depending on the resiliency, size and spacing of the dimples 128 as well as the amount of opposing stopping force, the computer 12 or other device can also enter into the first deceleration zone 130 by depressing or crushing one or more of the dimples 128. Accordingly, potentially damaging forces that might be incurred during bumping or dropping are substantially reduced. Once the opposing force is removed, the inner compartment and dimples will return to their respective undeformed positions and/or shapes.

Figure 7:
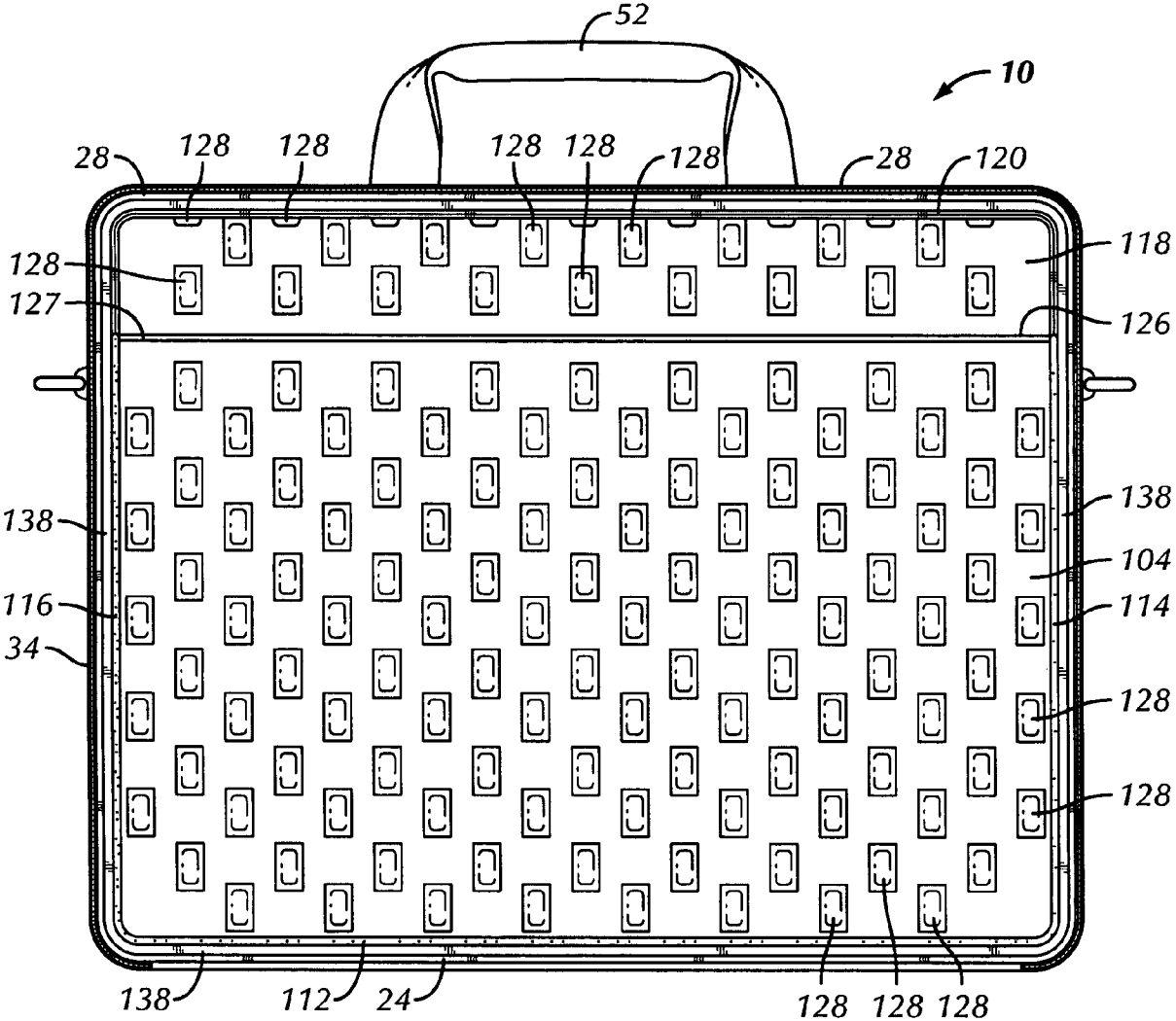
FIG. 7 is a sectional view of the carrying case taken along line 7-7 of FIG. 1 with the interior compartment in a closed position.
Figure 7A:
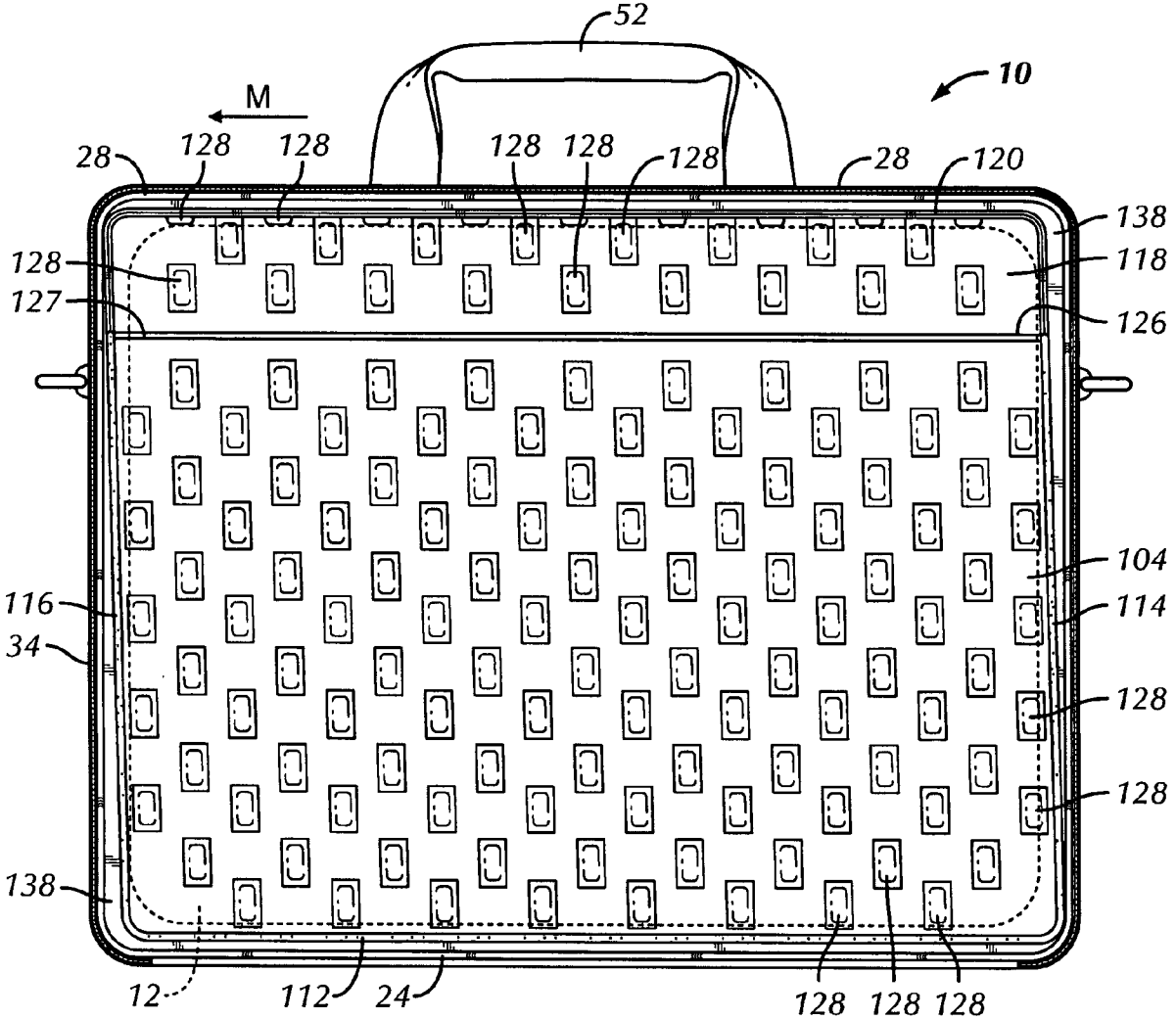
FIG. 7A is a sectional view similar to FIG. 7 showing movement of the interior compartment when subjected to a force along a fourth direction perpendicular to the first, second and third directions.
Figure 7B:
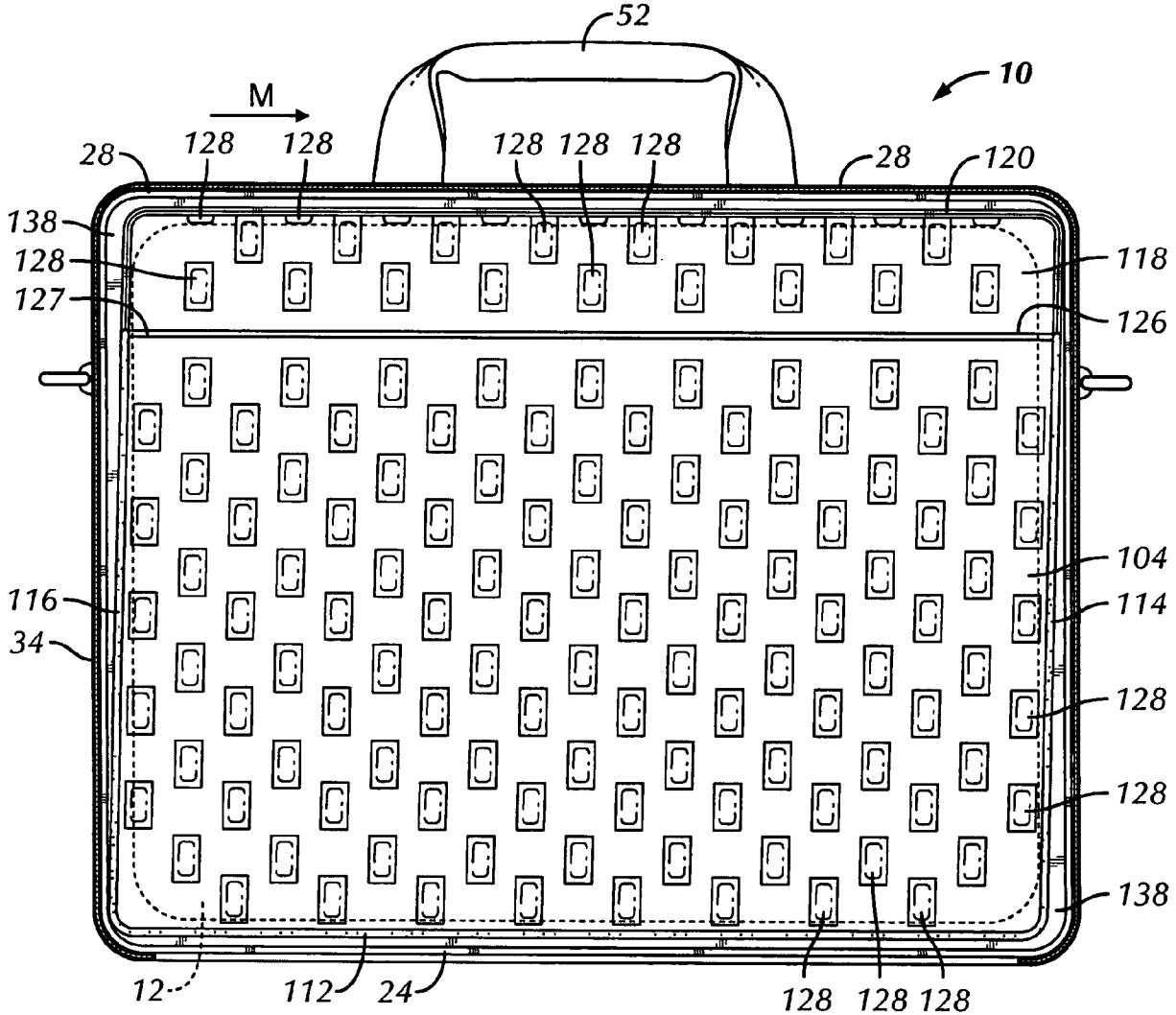
FIG. 7B is a sectional view similar to FIG. 7 showing movement of the interior compartment when subjected to a force along a fifth direction opposite to the fourth direction.
Figure 7D:
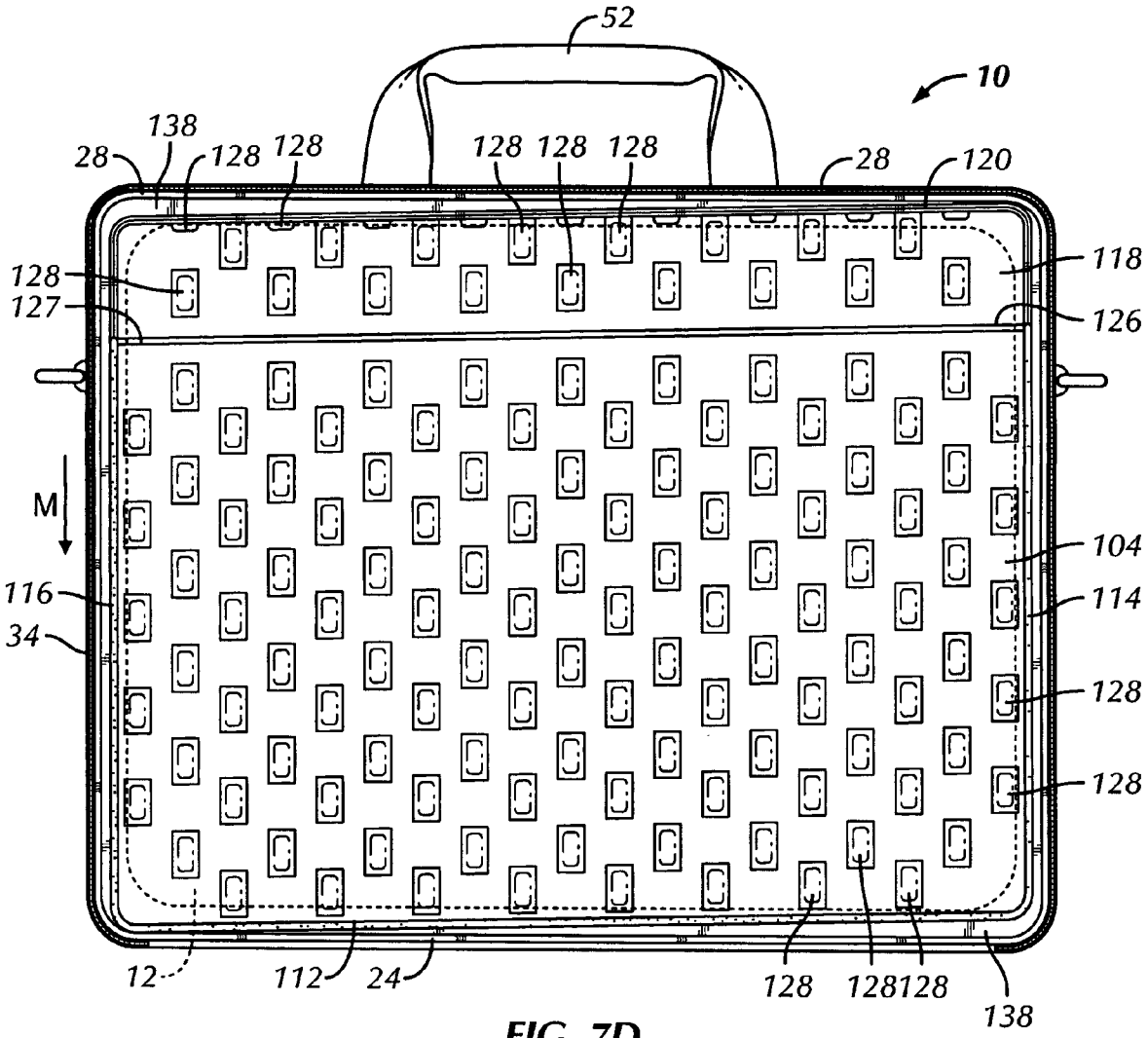
FIG. 7D is a sectional view similar to FIG. 7 showing movement of the interior compartment when subjected to a force along the second direction.
Figure 8:
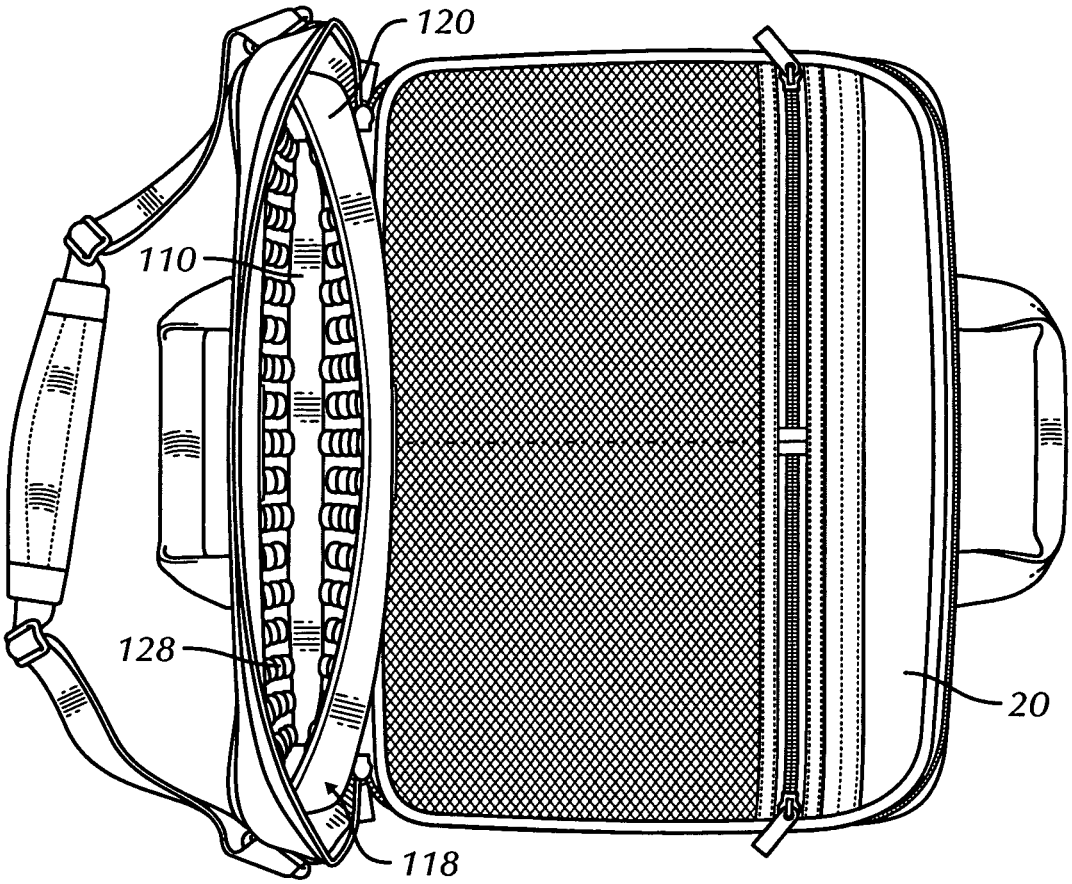
FIG. 8 is another view of the carrying case showing a partially open interior compartment.

Likewise, when the carrying case 10 travels along a second direction of the first axis, as denoted by arrow M in FIGS. 5B and 7D, and meets an opposing stopping force, a portion of the inner compartment 14 is capable of moving into the second deceleration zone 138 such that a greater gap is located at the top of the interior space 18 (FIG. 5) than at the bottom thereof, while the computer 12 or other device is capable of moving into the first deceleration zone 130.

As shown in FIG. 5C, when the carrying case travels along a first direction of a second axis perpendicular to the first axis, as denoted by arrow M, an opposing force will cause the inner compartment 14 to move into the second deceleration zone 138 while the computer 12 or other device moves into the first deceleration zone 130. Movement in the illustrated direction causes a gap 140 to appear between the rear panel 106 of the inner compartment 16 and the rear wall 22 (FIG. 5) of the outer case 14 due to the manner in which the inner compartment is attached to the rear wall via the continuous rear seam 44.

As shown in FIG. 7A, when the carrying case travels along a first direction of a third axis perpendicular to the first and second axes as denoted by arrow M, an opposing force will cause the inner compartment 14 to move into the second deceleration zone 138 while the computer 12 or other device moves into the first deceleration zone 130 such that the gap at the upper right corner of the carrying case is larger than a gap at the upper left corner thereof. Likewise, as shown in FIG. 7B, when the carrying case travels along a second direction of the third axis and meets an opposing force, the gap at the upper left corner of the carrying case will be larger than a gap at the upper right corner thereof. Accordingly, it can be seen that the carrying case of the instant invention is capable of reducing potentially damaging forces on the computer 12 or other device along three mutually perpendicular axes or practically any combination thereof.

The provision of a carrying case 10 with an outer case 14 and a reinforced inner compartment 16 located within the interior space 18 of the outer case that is suspended in a cantilever-type fashion from one of the walls of the outer case through a unique continuous seam construction and spaced from the outer case, together with the provision of dimples on the inner compartment that project into the interior thereof to thereby create two separate and independent deceleration zones in accordance with the unique features of the present invention thus provide superior protection for the contents of the inner compartment 16 over prior art solutions without sacrificing cost or quality.

It will be understood that the term "preferably" as used throughout the specification refers to one or more exemplary embodiments of the invention and therefore is not to be interpreted in any limiting sense. It will be further understood that the term "connect" and its various derivatives as may be used throughout the specification refer to components that may be joined together either directly or through one or more intermediate members. In addition, terms of orientation and/or position as may be used throughout the specification, such as top, right, left, bottom, front, rear, inner, outer, and so on, relate to relative rather than absolute orientations and/or positions.

It will be appreciated by those skilled in the art that changes could be made to the embodiments described above without departing from the broad inventive concept thereof. By way of example, although the rear panel 106 is preferably formed separately from the rear wall of the outer case, it can be eliminated so that the rear wall of the outer case forms the rear panel of the inner compartment. In addition, it will be understood that the inner compartment can be suspended from the front wall of the outer case rather than the rear wall without departing from the spirit and scope of the present invention. It will be understood, therefore, that this invention is not limited to the particular embodiments disclosed, but is intended to cover modifications within the spirit and scope of the present invention as defined by the appended claims.

What is claimed is:

1. A carrying case for a portable electronic device, the carrying case comprising:

an outer case having a front wall, a rear wall, and a side wall extending between and peripherally around the front and rear walls;

an inner compartment located within the outer case, the inner compartment including a front panel and a side panel extending peripherally around the front panel to define a hollow interior into which the portable electronic device can be received;

a pivotal flap extending across width of the front panel to thereby close the hollow interior of the inner compartment, the pivotal flap being formed as an upper part of the front panel connected thereto through a living hinge that extends across the width of the front panel; and a plurality of spaced resilient dimples extending into the interior of the inner compartment from at least the front panel, the living hinge comprises at least an internal crease in a front panel material formed between two adjacent rows of the resilient dimples, said internal crease extends inwardly in to the material toward an exterior of the inner compartment from the front panel, so that thickness of the material at the living hinge is being minimized.

2. A carrying case according to claim 1, wherein the living hinge further comprises an external crease.

3. A carrying case according to claim 1, wherein the front panel material consists of multiple fabric layers.

4. A carrying case according to claim 1, wherein the inner compartment is suspended in a cantilever fashion from one of the walls of the outer case.

5. A carrying case according to claim 1, wherein the living hinge further comprises stitching extending across the width of the front panel.

6. A carrying case according to claim 5, wherein the pivotal flap further comprises a top panel section that extends from the front panel and mates with the side panel when in the closed position.

7. A carrying case according to claim 6, wherein the upper part of the front panel can rest against the front panel and the top panel section can rest against the upper part of the front panel when the pivotal flap is in a fully open position.

8. A carrying case according to claim 1, wherein the living hinge comprises stitching extending across the width of the front panel thereby creating the crease in a fold of the material.

9. A carrying case according to claim 1, wherein the inner compartment located within the outer case is being suspended in a cantilever-type fashion from one of the walls of the outer case, the side panel being spaced from the side wall to define a deceleration zone into which a portion of the inner compartment can travel when the carrying case is subjected to a deceleration force to thereby protect the portable electronic device from full impact of the deceleration force.

10. A carrying case according to claim 9, wherein the front panel is spaced from the front wall to further define the deceleration zone so that a substantial portion of the inner compartment is surrounded by the deceleration zone within the outer case.

11. A carrying case according to claim 10, and further comprising a space between outer free ends of the dimples defining another deceleration zone into which the portable electronic device can travel when the portable electronic device is subjected to the deceleration force to compress at least one of the dimples to thereby further protect the portable electronic device from full impact of the deceleration force.

12. A carrying case according to claim 11, wherein the inner compartment further comprises a rear panel connected to the side panel.

13. A carrying case according to claim 12, wherein the plurality of spaced resilient dimples also extend into the interior of the inner compartment from the rear panel.

14. A carrying case according to claim 13, wherein the plurality of spaced resilient dimples also extend into the interior of the inner compartment from the pivotal flap.

15. A carrying case according to claim 9, wherein outer peripheral edges of the front wall and side wall are connected together through a continuous front seam.

16. A carrying case according to claim 9, wherein outer peripheral edges of the rear wall, side wall and side panel are connected together through a continuous rear seam to thereby cause the inner compartment to be suspended in the cantilever-type fashion from the rear wall of the outer case.

* * * * *